United States Patent [19]

Lee

[11] 4,249,444

[45] Feb. 10, 1981

[54] STABILIZING MEANS FOR THE CUTTER OF NUT FORMER

[75] Inventor: Shi-Chung Lee, Kangshan, Taiwan

[73] Assignee: Chun Zu Machinery Ind. Co., Ltd., Kangshan, Taiwan

[21] Appl. No.: 37,768

[22] Filed: May 10, 1979

[51] Int. Cl.[3] ..... B26D 5/08; B26D 5/16

[52] U.S. Cl. ..... 83/588; 10/72 R; 83/627

[58] Field of Search ..... 10/25, 72 R; 83/588, 83/627, 589, 628

[56] References Cited

U.S. PATENT DOCUMENTS

| | | | |
|---|---|---|---|
| 2,340,162 | 1/1944 | Whistler et al. | 83/588 |
| 2,539,085 | 1/1951 | Kerseg | 83/627 |
| 3,541,909 | 11/1970 | Franzen | 83/588 |
| 3,958,476 | 5/1976 | Bartha | 83/588 X |
| 4,023,452 | 5/1977 | Lee | 83/588 X |
| 4,062,258 | 12/1977 | Lee | 83/588 X |

FOREIGN PATENT DOCUMENTS

| | | | |
|---|---|---|---|
| 14344 | of 1909 | United Kingdom | 83/627 |

*Primary Examiner*—Ervin M. Combs

[57] ABSTRACT

The present invention relates to an improved means for the stability control assembly of a cutter of nut former. This means comprizes a driving roller positioned on the center line of movement of the cutter axis enabling the cutter not to roll driving the process of cutting. A plate spring and helical spring cooperate together to reduce the variation range of spring strength, this minimizing wearing of each operating part and to reduce chattering of the cutting tool.

8 Claims, 6 Drawing Figures

STABILIZING MEANS FOR THE CUTTER OF NUT FORMER

BACKGROUND OF THE INVENTION

This invention relates to an improved apparatus for the stability control of a cutter of a nut former. A driving roller placed on the center line of the cutter axis operates in the same direction as the cutter. A pin spindle, slide block and a compressed rod inhibit the cutter from rolling and obtain a uniformity in shearing section of the cutter material. A plate spring and a compressed helical spring are used so that the cutter can avoid chattering (i.e. vibrations and accelerations of the tool) and advance smoothly. For a given same displacement of the cutter, the displacement of the compressed spring is less in compression. As a result, a smaller helical spring may be used and less wear among contacting and sliding surfaces occurs resulting in greater longevity of the apparatus.

The conventional control mechanism of a cutter used in a nut former is disclosed in FIG. 1. The movement of cam 11 causes cam follower and roller 12 to move along a guide slot 111 which in turn urges cutter 13 forward. By means of compressed helical spring 14, the cutter 13 is urged in the direction of Arrow A. Thus cam follower 12 is always urged against the inside surface of guide slot 111 of cam 11. This is to avoid chattering, vibrating or accelleration of cutter at the time of cutting. However, cam 12 is situated below cutter 13 and has a certain clearance (that is to say, moment arm). From a dynamics point of view, cam follower 12 which is driven by a perpendicular component of force to drive the cutter 13 forward must have a horizontal component of force in parallel with cam 11. The horizontal component of force applied on cam 12 and the moment arm form a moment of force and cause the cutter 13 to tend to about its axis. The resulting inability to obtain uniformity of shearing surface of material molding and punch as tends to cause damaging during molding and punch operations. In addition, the yield of defective products increases, thereby hurting production efficiency. For the purpose of reducing the rolling of cutter 13 which is unavoidable, and avoiding chattering at the time of cutting material, a longer compressed helical spring with larger diameter could be used. Practically speaking, the function of compressed helical spring is to reduce the rolling of the cutter and the chattering at the moment of cutting. And the maximum horizontal force applied on the cam 12 takes place within the cutting distance of material by a cutter. From experience and experiment, cutting of material occurs when a cutter cuts into three-tenths of the diameter of a material. In other words, the force of spring reaches maximum when three-tenths of material diamer has been cut be for obtaining the advantage of reducing the rotation of cutter and chattering. But the spring force of the conventional cutter reaches maximum when cutting process nears the end, that is to say, $F=KX$. As a result, when roller, pin spindle and sliding plate in contact with each sliding surface advance material through the cutter, the force of the spring 14 increases uselessly, thereby increasing the rate of wear and shortening their life. It also causes waste of power.

SUMMARY OF THE INVENTION

In view of the foregoing, the main object of the invention is to provide an improved apparatus to eliminate the aforementioned defects of the conventional cutter. The means includes a roller along the cutter axis and is driven in the direction of the cutter line of movement. A concave plate assembly to enables the cutter not to roll in the process of cutting and obtains uniformity of shearing surface of material.

Another object of the present invention is to provide a means having a compressed helical spring to indirectly control, by a connecting member, the roller to roll tightly against the convex plate so that motion through the process of cutting is stable and without chattering. Furthermore another object is to reduce the variation range of spring force, thereby minimizing wearing of each operating part. The spring force is preferably readily adjustable if needed.

Still another object is to provide a flexible plate spring used as a transmitting rod to increase the advance ratio of compression link to compressed helical spring in the process of cutting so as to maintain a stable operation and to continuously move material forward with a constant spring force after cutting, thereby minimizing wearing of pin spindle, roller, convex plate and sliding block.

These and other objects, features and advantages of the invention will become apparent from the following description with reference to the drawings.

DETAILED DESCRIPTION OF THE PREFERRED EMBODIMENT

Figure 1:
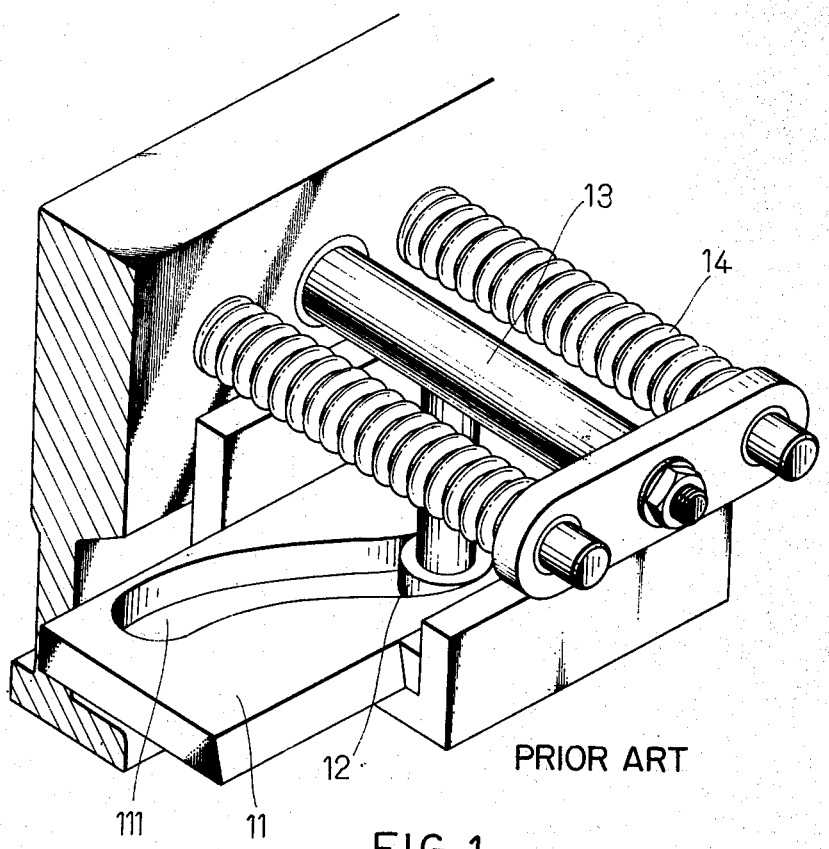
FIG. 1 is a fragmentary perspective view of a conventional control mechanism of a cutter adapted in a nut former.
Figure 2:
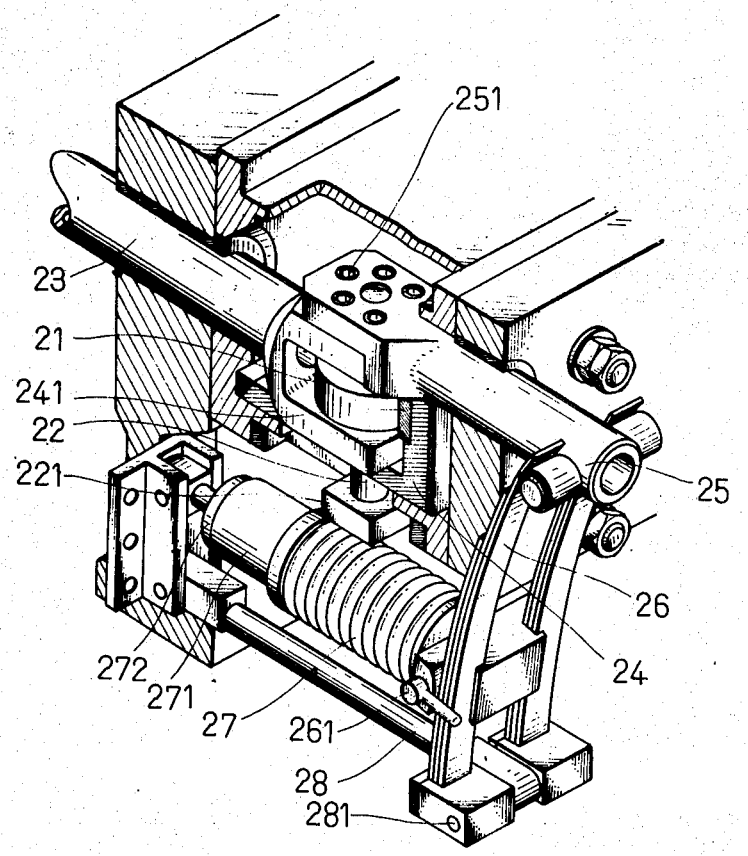
FIG. 2 is a perspective exploded view of an embodiment in accordance with the present invention.
Figure 3:
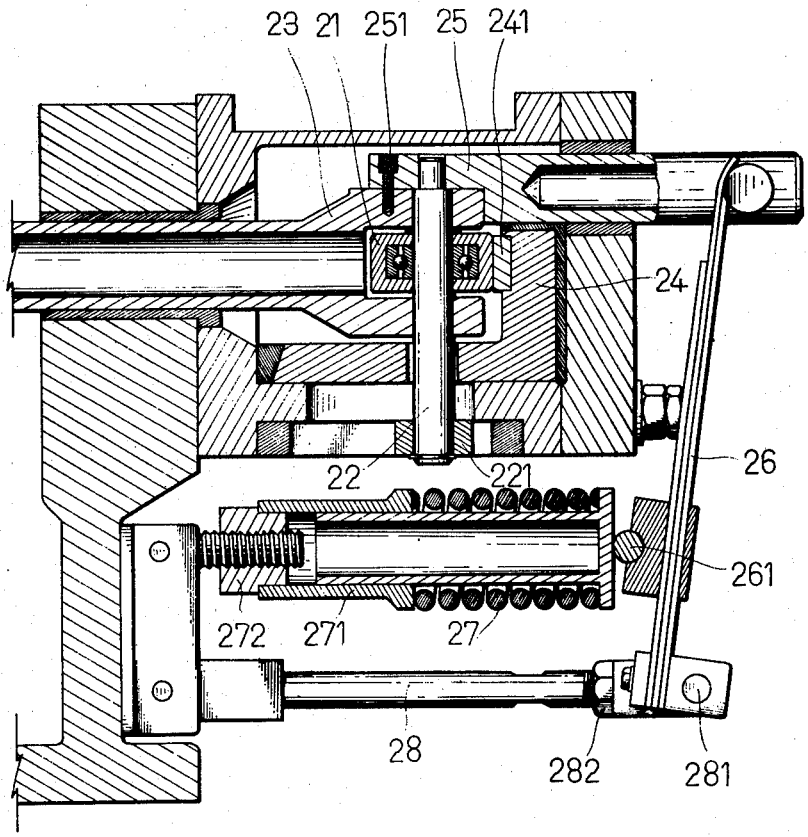
FIG. 3 is a side sectional view of an embodiment in accordance with the present invention.
Figure 4:
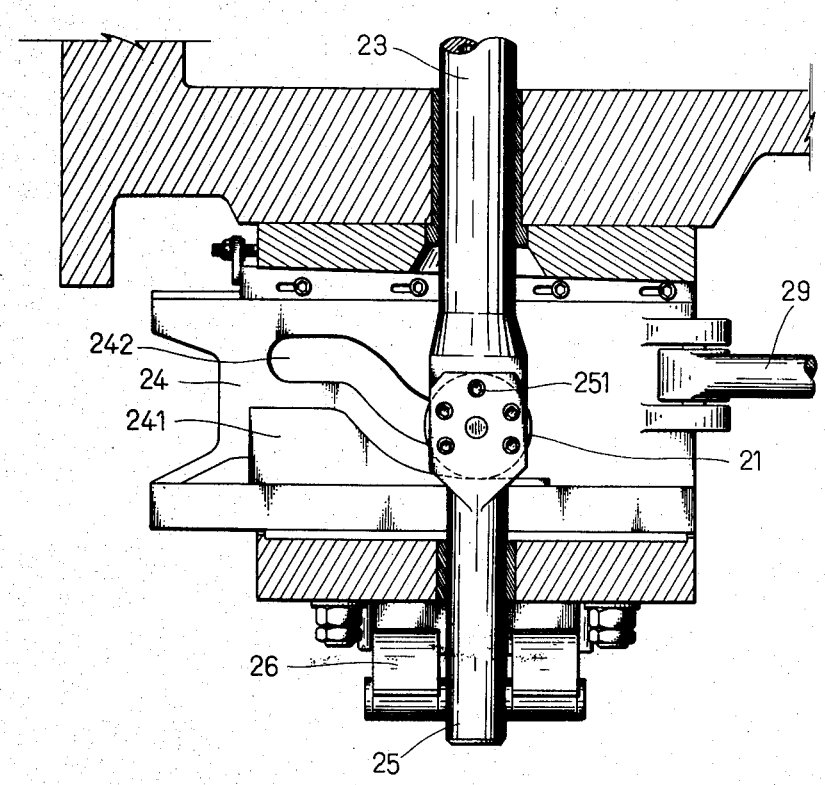
FIG. 4 is a top view of an embodiment in accordance with the present invention.

Refer to FIGS. 2 3 and 4, which show respectively, a perspective, a side and a top sectional view of an embodiment of the present invention. A roller 21 is installed inside the U shaped receiving seat and on a pin spindle 22 a convex plate 241 is fastened to the driving slide block 24 and defines a cam surface. One end of link 25 is secured to the upper half of the receiving seat by screws 251 and the other end is connected to a plate or leaf spring 26. The upper end of pin spindle 22 penetrates through link 25, and the lower end of the pin spindle 22 passes through an operative or opening 242 in the driving slide block 24, the opening 242 having the same curvature as convex plate 241. The lower end of the pin spindle is secured to a slide block 221 to hold the pin spindle. One end of the plate spring 26 bears on link 25 and the other end is via connected a pin spindle 281 to an adjustable link 28, the end of which has a screw nut 282.

The compression helical spring 27 is securely connected by a rolling pin 261 to the plate spring 26 and the receiving seat 271 of compression helical spring 27 is situated on the adjustable screw 272.

The driving slide block 24 reciprocates by means of a connecting rod 29 driven by a motor (not shown). The convex plate 241 secured to driving slide block 24 also reciprocates with driving slide block 24. The reciprocating motion of convex plate 241 drives roller 21 in accordance with the cam surface of convex plate 241 and forces the cutter 23 to move forward at right andles to the motion of driving slide block 24. Cutter 23 is urged backward in response to springs 26,27. As the roller 21 is situated in the receiving seat of cutter 23 on the center line of motion of the cutter 23 the force moving the cutter 23 forward is also on the center line of the cutter 23. When the cutter 23 moves forward, the pin spindle 22 simultaneously moves forward along the slot which is provided in the driving slide block 24 and which has the same curve with the convex plate. The slide block 221, fastened to the bottom end of pin spindle, also move correspondingly. As the pin spindle 22 also penetrates link 25, the roller 21 drives the cutter 23 on the same axial center line, thus causing no rolling phenomenon (as the moment arm is zero, no moment of force is generated). At the same time, the slide block 221 and the link 25 form a stable point or plane, thus no rotation phenomenon is detected in the process of cutting.

Figure 5A:
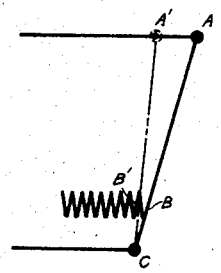
FIG. 5*a* is a diagrammatic illustration of a inflexible link and a helical spring.

In a nutshell, a uniformity of shearing section of material results, and material feeding, material clamping and compression processes are more accurate, thereby minimizing the wearing of molding and the reducing of devective products. The forward movement of cutter 23 is made by the convex plate 241 and the backward movement is made by plate spring 26 and the force of compression helical spring 27 with the roller 21 abutting to the surface of convex plate 241. The chattering of the cutter at the instant of cutting is avoided by means of the spring force. The above mechanism has the following features: As shown in FIG. 5*a*, first assume that the plate spring 26 is an inflexible link. The displacement of cutter 23 equals to that of the link 25. That is $\overline{AA'}$ and the compression distance of compression helical spring 27 is $\overline{BB'}$. As $\overline{BB'}=\overline{AA'}\ \overline{BC}/\overline{AC}$, and according to HOOKE'S LAW, $F=K\ (\overline{BB'})$. As the ratio of $(\overline{BB'})$ to the displacement of cutter $(\overline{AA'})$ decreases excessively, the variation range of spring force becomes smaller. In a word, from the begining to the completion of cutting process, the variation range of spring force decreases from $K(\overline{AA'})$ to $K(\overline{BB'})$. As the cutter has no rolling phenomenon and the spring force is used mainly to avoid chattering at the instant of cutting material, a spring of smaller diameter can be used and the wearing of each moving part, such as pin spindle, convex plate and slide block is minimized.

Figure 5B:
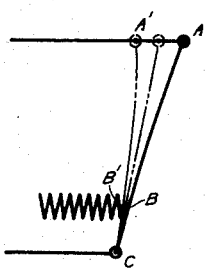
FIG. 5*b* is a diagrammatic illustration of a plate spring and a compressed helical spring in accordance with the invention.

The connecting rod, however, is in a form of a plate spring 26 with considerable flexibility. As shown in FIG. 5*b*, the plate spring is in a bending form because of its spring force (at A position). In the early stage of displacement of cutting, the plate spring pulled by the compression link, compresses the helical spring. The plate spring is bent slightly as the spring force increases. In fact, from the experience of material cutting, material is cut off when the displacement of cutter is three tenths of diameter of nut material. Owing to this fact, the stable spring force necessary to avoid chattering of cutter at the instant of cutting off material should reach a certain value when a cutter cuts into three tenths of the diameter of material, and should be kept within a small range during the stage of material feeding after the material has been cut off. The present invention is designed on the basis of this fact. When the link 25 pulls the plate spring 26 to compress the compression helical spring until the material is cut off, the spring force of compression helical spring 27 reaches a certain value which is capable of overcoming the chattering vibration or acceleration otherwise caused by the completion of cutting by the cutter.

When this value is reached, the plate spring 26 pulled by the compression link 25 continues to bend and the helical spring 27 also continues to be compressed slightly. This proves that the compressed distance $(\overline{BB'})$ of compression helical spring is actually shorter. As a result, a shorter compression helical spring may be employed; the body of the apparatus decreases to two thirds of the conventional means, thereby decreasing the space required for this assembly. As the variation range of spring force required for overcoming the chattering, vibration or acceleration of cutter decreases, the wearing between each moving part, such as pin spindle, convex plate and slide break, is also minimized, thereby promoting longevity of each moving part. The displacement of compression spring 27 is readily and effectively adjustable by the adjusting link 28 and the nut 272 so as to obtain the most appropriate value of spring force applied to the link.

What we claim is:

1. A stabilizing apparatus for a cutter comprising:

(a) a body;

(b) a moveable assembly in said body for moving said cutter, said assembly including a roller disposed in an end thereof essentially in alignment with a center line of movement of said movable assembly;

(c) a driving block slideably mounted in said body, said block including a cam surface disposed in confronting relationship to said roller;

(d) a helical spring coupled to said body at one end thereof;

(e) a plate spring;

(f) bearing means disposed at an end of said helical spring opposite to said one end for bearing said helical spring upon said plate spring;

(g) first means operatively coupling one end of said plate spring to said movable assembly; and (h) second means operatively coupling said end of said plate spring opposite to said one end of said body.

2. The apparatus accordingly to claim 1, further including means for inhibiting the rotation of said movable assembly about said center line.

3. A stabilizing apparatus according to claim 2, wherein said means for inhibiting rotational movement include a pin spindle attached to said movable assembly and having an axis essentially coaxial with the axis of said roller, and wherein said moveable assembly includes an aperture having essentially the same curvature as said cam surface, said pin spindle being disposed to penetrate through said aperture.

4. A stabilizing apparatus according to claim 3, wherein said movable assembly includes a groove therein and further comprising a slide block connected to said pin spindle, said slide block being arranged for movement in said groove in said movable assembly.

5. A stabilizing apparatus according to claims 1 or 4, wherein said first means comprises a mechanical link having at least one protuberance therein for engaging said one end of said plate spring 6. A stabilizing apparatus according to claim 1, wherein said bearing means includes a revolving pin and seat arrangement.

7. A stabilizing apparatus according to claim 1, wherein said second means is an adjustable link and wherein said helical spring includes an adjustable spring seat, so that a stabilizing spring force generated by said helical spring and said plate spring is adjustable by said adjusting link and said adjustable spring seat.

8. A stabilizing apparatus according to claim 1, wherein said driving block, when reciprocated in said body, causes reciprocating movement of said movable assembly at right angles to the direction of movement of said driving block.

* * * * *